US005304448A

United States Patent [19]

Keoshkerian et al.

[11] Patent Number: 5,304,448

[45] Date of Patent: Apr. 19, 1994

[54] ENCAPSULATED TONER COMPOSITIONS

[75] Inventors: Barkev Keoshkerian, Thornhill; Beng S. Ong, Mississauga; Padam K. Angra, Brampton, all of Canada

[73] Assignee: Xerox Corporation, Stamford, Conn.

[21] Appl. No.: 898,669

[22] Filed: Jun. 15, 1992

[51] Int. Cl.[5] ..... G03G 9/093

[52] U.S. Cl. ..... 430/109; 430/138

[58] Field of Search ..... 430/106, 138, 109

[56] References Cited

U.S. PATENT DOCUMENTS

| | | | |
|---|---|---|---|
| 4,442,194 | 4/1984 | Mikami | 430/137 |
| 4,877,706 | 10/1989 | Mahabadi et al. | 430/110 |
| 5,013,630 | 5/1991 | Ong et al. | 430/138 |
| 5,023,159 | 6/1991 | Ong et al. | 430/109 |
| 5,045,422 | 9/1991 | Kmiecik-Lawrynowicz et al. | 430/109 |
| 5,045,428 | 9/1991 | Sacripante et al. | 430/138 |
| 5,082,757 | 1/1992 | Keoshkerian et al. | 430/106 |
| 5,120,475 | 6/1992 | Chen et al. | 430/138 |
| 5,229,243 | 7/1993 | Sasaki et al. | 430/109 |

*Primary Examiner*—Christopher Rodee
*Attorney, Agent, or Firm*—E. O. Palazzo

[57] ABSTRACT

An encapsulated toner composition comprised of a core comprised of a polymer binder and pigment, encapsulated in a shell derived from the polycondensation of a polyisocyanate and amino acid with an amide or hydroxy functionality.

10 Claims, No Drawings

ENCAPSULATED TONER COMPOSITIONS

BACKGROUND OF THE INVENTION

The present invention is generally directed to toner compositions, and more specifically to encapsulated toner compositions. In one embodiment, the present invention relates to encapsulated toner compositions comprised of a core comprised of a polymer binder and pigments, including color pigments, dyes, or mixtures thereof, and a polymeric microcapsule shell thereover prepared, for example, by interfacial polymerization. Another embodiment of the present invention relates to shell formation by interfacial polycondensation of a polyisocyanate such as a diisocyanate, triisocyanate, or the like with an amino acid. In embodiments, the present invention provides encapsulated toner compositions whose shells are derived from the reaction of a polyisocyanate and an amino acid which contains an amide or hydroxy functionality. The core polymer can be generated by addition polymerization of vinyl monomers after microcapsule shell formation. The microcapsule shell of the present invention is highly polar in nature, and is very effective in containing the relatively nonpolar core polymer. Effective containment of core components can be of importance for encapsulated toners which contain soft core components such as core polymers of low glass transition temperatures, and diffusible or liquid components such as dye molecules and solvents, which may leach or diffuse out of the shell, and can therefore in many instances give rise to undesirable problems such as toner agglomeration and blocking, and toner smearing. These and other disadvantages are eliminated or minimized with the toners of the present invention. In embodiments, the present invention is directed to pressure fixable encapsulated toner compositions which provide high initial and final image fix under low pressure fixing conditions, and which toners are comprised of a core of polymer binders and colorants including magnetic pigments such as magnetites, encapsulated thereover with a microcapsule shell derived from the polycondensation of a diisocyanate, a triisocyanate or mixtures thereof with an amino acid which possesses an amide or hydroxy function. The image fix level of developed images of an encapsulated toner under pressure fixing conditions is generally dependent on the rate of the diffusion of its core components, primarily the core polymer binder, out of the ruptured toner to fix onto paper; the image fix level is therefore a function of time, and the optimum fix is usually achieved within about several hours to 24 hours after the toner is ruptured. The initial fix, that is the fix level after 1 or 2 minutes of toner rupture, of a number of pressure fixable toners at low fixing pressure of, for example, about 2,000 psi is usually from about 5 to 30 percent. This marginal initial fix may not be sufficient for duplex imaging and printing applications since the low initial fix may cause image offset to the pressure roll or severe image smear during these processes. Accordingly, in embodiments of the present invention there are provided encapsulated toner compositions which also offer high initial fix of, for example, in excess of 40 percent, and which toners are obtained by encapsulating a core composition of a polymer binder and a colorant with a microcapsule shell derived from the interfacial polycondensation of a polyisocyanate and an amino acid such as glutamine. The aforementioned relatively high initial fix level is believed to be sufficient to overcome the image offset and image smear problems in duplex imaging and printing. The aforementioned toners possess a number of advantages as illustrated herein including the high initial fix of developed images to paper of about 50 percent within, for example, from about 1 to about 2 minutes after fixing, and a final fix of over 85 to 95 percent at low fixing pressure of, for example, 2,000 psi in embodiments thereby enabling duplex imaging and printing processes to be properly accomplished; preventing or minimizing leaching or loss of the core components especially the core polymer binder; avoidance or minimization of agglomeration; elimination and/or the minimization of image ghosting; and acceptable powder flow characteristics and surface release properties. In another embodiment of the present invention, the toner compositions obtained can include thereon an electroconductive material thereby permitting compositions with a controlled and stable volume resistivity such as, for example, from about $10^3$ to about $10^8$ ohm-cm, and preferably from about $10^4$ to about $10^7$ ohm-cm, which toners are particularly useful for inductive single component development processes. The toner compositions of the present invention also provide a shell with substantially improved mechanical properties, and which shell does not rupture prematurely causing the core component comprised, for example, of a polymer binder and magnetite, or other color pigment to become exposed, and thereafter contaminating the image development subsystem surfaces or forming undesirable agglomerates. The toners of the present invention also provide for the complete or substantially complete transfer of the developed images to a paper substrate during the development process. The toner compositions of the present invention can be selected for a variety of known reprographic imaging processes including electrophotographic and ionographic processes. In embodiments, the toner compositions of the present invention are selected for pressure fixing processes for ionographic printing wherein dielectric receivers, such as silicon carbide, are utilized, reference U.S. Pat. No. 4,885,220, the disclosure of which is totally incorporated herein by reference. Specifically, the toner compositions of the present invention can be selected for image development in commercial Delphax printers such as the Delphax S9000 TM, S6000 TM, S4500 TM, S3000 TM, and Xerox Corporation printers such as the 4060 and 4075 wherein, for example, transfixing is utilized, that is fixing of the developed image is accomplished by simultaneously transferring and fixing the developed images to a paper substrate with pressure. Another application of the toner compositions of the present invention resides in their use for two component development systems wherein, for example, the image toning and transfer are accomplished electrostatically, and the fixing of the transferred image is achieved by application of pressure with or without the assistance of thermal energy.

The toner compositions of the present invention can, in embodiments, be prepared by a shell forming interfacial polycondensation, followed by a core polymer binder forming free radical polymerization of a vinyl monomer or monomers initiated by thermal decomposition of a free radical initiator. One embodiment of the present invention is directed to a process for the simple and economical preparation of pressure fixable encapsulated toner compositions by a chemical microencapsulation method involving an interfacial polycondensation and a free radical polymerization, and wherein there are selected, for example, acrylates, methacrylates or styryl derivatives as core monomers, color pigments or dyes as colorants, and polyisocyanates and an amino acid such as glutamine as shell precursors to provide an encapsulated toner. Further, in another process aspect of the present invention the encapsulated toners can be prepared in the absence of flammable organic solvents, thus eliminating explosion hazards associated therewith; and furthermore, these processes do not require costly and hazardous solvent separation and recovery steps. Moreover, with the process of the present invention there can be obtained in some instances improved yields of toner products since, for example, the extraneous solvent component can be replaced by liquid shell and core precursors.

A number of encapsulated toners are known, including those wherein the shell is comprised of the reaction product of a diisocyanate and an amine component, reference for example U.S. Pat. No. 5,023,159; 5,045,422; 5,013,630; 5,045,428 and 4,877,706, see columns 6 and 7 for example. Also, in U.S. Pat. No. 5,082,757, the disclosure of which is totally incorporated herein by reference, there are illustrated encapsulated toners with a core comprised of a polymer binder, pigment or dye, and thereover a hydroxylated polyurethane shell, and which shell has the ability to effectively contain the core binder and prevent its loss through diffusion and leaching processes. Specifically, there are illustrated in this patent encapsulated toners comprised of a core containing a polymer binder, pigment or dye particles, and thereover a hydroxylated polyurethane shell derived from the polycondensation of a polyisocyanate and a water-soluble carbohydrate, such as a monosaccharide, a disaccharide or their derivatives, with the polycondensation being accomplished by known interfacial polymerization methods. According to U.S. Pat. No. 5,082,757, the encapsulated toner compositions are mechanically stable and possess acceptable shelf life stability in most, if not all, embodiments thereof. For example, they do not suffer from premature rupture, and are nonblocking and nonagglomerating, however, such shells do not usually provide complete shell coverage because of the low reactivity of the precursor monomers selected. The shell materials are considered robust and display a low degree of shell permeability to the core components, and in particular to the core polymer binder. In addition, the toner compositions of this patent enable the achievement of a relatively high initial fix of, for example, 50 percent thereby permitting the toner compositions to be utilized in duplex printing and imaging systems without undue complications such as image offset or image smear. Furthermore, the toner compositions of this patent offer in some embodiments very high final image fix of 85 to 95 percent, thereby ensuring excellent image permanence characteristics for high quality printing. The present invention provides unique encapsulated toner compositions which offer stable toner performance irrespective of extreme environmental conditions, such as from about 15 to 85 percent relative humidity at temperatures ranging from ambient to about 50° or 60° C., excellent powder flow characteristics, and comparatively long shelf life of over two years, in addition to achieving all the above mentioned benefits. Also, with the toner compositions of the present invention, advantages in embodiments thereof include: (1) high fixing, and both high initial and high final image fix levels under low pressure fixing conditions; (2) utilization of relatively robust, yet pressure-rupturable, shells derived from the polycondensation of readily available nontoxic amino acids, particularly those that contain an amide function such as glutamine, and polyisocyanates; and (3) highly polar shell materials which are able to effectively suppress or inhibit the diffusion and leaching of the relatively nonpolar core polymer binder.

Also mentioned are U.S. Pat. No. 4,442,194 which discloses encapsulated toners with shells comprised of substances (A) and (B), see column 3 for example, wherein (A) can be an isocyanate and (B) can be an active hydrogen containing compound, see column 4, such as polyols, water, and the like, see column 5; a similar teaching is present in U.S. Pat. No. 4,699,866; U.S. Pat. No. 3,898,171 which discloses an electroscopic powder formulated with sucrose benzoate and a thermoplastic resin, see for example column 2; and U.S. Pat. Nos. 4,465,755 and 4,592,957.

With further specific reference to the prior art, there are disclosed in U.S. Pat. No. 4,307,169, the disclosure of which is totally incorporated herein by reference, microcapsular electrostatic marking particles containing a pressure fixable core, and an encapsulating substance comprised of a pressure rupturable shell, wherein the shell is formed by an interfacial polymerization. One shell prepared in accordance with the teachings of this patent is a polyamide obtained by interfacial polymerization. Furthermore, there are disclosed in U.S. Pat. No. 4,407,922 pressure sensitive toner compositions comprised of a blend of two immiscible polymers selected from the group consisting of certain polymers as a hard component, and polyoctyldecylvinylether-comaleic anhydride as a soft component. Interfacial polymerization processes are also selected for the preparation of the toners of this patent.

Illustrated in U.S. Pat. No. 4,758,506, the disclosure of which is totally incorporated herein by reference, are single component cold pressure fixable toner compositions, wherein the shell selected can be prepared by an interfacial polymerization process. Further, in U.S. Pat. No. 5,043,240, the disclosure of which is totally incorporated herein by reference, there are illustrated encapsulated toners with a core comprised of a polymer binder, pigment or dye, and thereover a polymeric shell, which contains a soft and flexible component, permitting, for example, proper packing of shell materials resulting in the formation of a high density shell structure, which can effectively contain the core binder and prevent its loss through diffusion and leaching processes. The soft and flexible component in one embodiment is comprised of a polyether function. Specifically, in one embodiment there are disclosed in the above-mentioned patent encapsulated toners comprised of a core containing a polymer binder, pigment or dye particles, and thereover a shell preferably obtained by interfacial polymerization, which shell has incorporated therein a polyether structural moiety. Another specific embodiment of this patent is directed to encapsulated toners comprised of a core of polymer binder, pigment, dye or mixtures thereof, and a polymeric shell of a polyether-incorporated polymer, such as a poly(ether urea), a poly(ether amide), a poly(ether ester), a poly(ether urethane), mixtures thereof, and the like.

There is a need for encapsulated toner compositions with many, and in some embodiments substantially, if not all, the advantages illustrated herein. More specifically, there is a need for encapsulated toners with shells that effectively eliminate or minimize the loss of core components such as the core polymer binder. Also, there is a need for encapsulated toners wherein images with excellent resolution and superior initial and final image fix levels can be obtained. Moreover, there is a need for encapsulated toners, including colored toners, wherein image ghosting and smearing, toner offsetting, and undesirable leaching of core components and the like are avoided or minimized. Additionally, there is a need for encapsulated toners, including colored toners with, in some instances, excellent surface release characteristics enabling efficient image transfer during image development and fixing processes. Furthermore, there is a need for encapsulated toners which have been surface treated with additives such as carbon blacks, graphite or the like to render them conductive to a volume resistivity level of preferably from about $10^3$ to about $10^8$ ohm-cm, and to enable their use in single component inductive development systems. Moreover, there is a need for pressure fixable encapsulated toners that can be utilized in transfix development systems under low pressure fixing conditions. There is also a need for processes for the preparation of encapsulated toners with the advantages mentioned herein. Furthermore, there is a need for toners and improved processes thereof that will enable the preparation of encapsulated toner compositions whose properties, such as shell strength, core binder molecular weight and the nature of core binder crosslinking, can be desirably controlled. A further need resides in the provision of encapsulated toners whose performance is insensitive to environmental extremes such as high and low humidity conditions. Another need is to provide encapsulated toners which can be obtained from readily accessible, nontoxic, and economical precursors such as amino acids.

SUMMARY OF THE INVENTION

It is an object of the present invention to provide encapsulated toner compositions with many of the advantages illustrated herein.

It is also an object of the present invention in embodiments to provide encapsulated toner compositions which provide desirable toner properties such as high initial and final image fix, excellent image crease and rub resistance, and excellent image permanence characteristics.

In another object of the present invention in embodiments there are provided simple and economical preparative processes for black and colored toner compositions involving an interfacial shell forming polymerization and a free radical core binder forming polymerization whereby the shell formation, core binder formation, and the resulting toner material properties can be independently and desirably controlled.

Another object of the present invention in embodiments resides in the provision of simple and economical processes for black and colored pressure fixable toner compositions with durable, pressure-rupturable thin carboxylated polyurea shells obtained by a chemical microencapsulation technique involving an interfacial polycondensation and a free radical polymerization process.

Furthermore, in another object of the present invention in embodiments there are provided substantially agglomeration free encapsulated toners with excellent flow characteristics.

In embodiments of the present invention, there are provided encapsulated toners with a core comprised of a polymer binder, color pigment or dye, and thereover a microcapsule shell which has the ability to effectively contain the core components and prevent their loss through diffusion and leaching processes. Specifically, in one embodiment there is provided in accordance with the present invention encapsulated toners comprised of a core containing a polymer binder, color pigment or dye, and thereover a microcapsule shell derived from the interfacial polycondensation of a polyisocyanate and an amino acid, preferably one which contains an amide or hydroxy functionality, such as glutamine and tyrosine. Another specific embodiment of the present invention is directed to pressure fixable encapsulated toners comprised of a core of polymer binder, magnetic pigment, optional color pigment, dye or mixtures thereof, and a microcapsule shell derived from polyisocyanates and amino acids, and which shell is coated thereover with a layer of conductive components such as carbon black.

The aforementioned toners of the present invention can be prepared by a chemical microencapsulation process comprising an interfacial polycondensation and a free radical polymerization. The process comprises dispersing a mixture of core vinyl monomers, colorants, free radical initiators, and one or more water immiscible polyisocyanates into stabilized microdroplets in an aqueous medium containing an emulsifying agent or a stabilizer. The type and concentration of the emulsifying agent or stabilizer employed in the generation of the stabilized microdroplets depend on a number of factors including, for example, the toner components, the viscosity of the mixture, and the desired toner particle size. The shell forming interfacial polymerization can be effected by the addition of an amino acid, preferably glutamine into the reaction medium. The amino acid from the aqueous phase reacts with the polyisocyanates from the microdroplet phase at the microdroplet/water interface resulting in the formation of a microcapsule shell around the microdroplet. The generation of the core polymer binder from, for example, vinyl monomers within the newly formed microcapsule is subsequently initiated by heating, thus completing the formation of an encapsulated toner particle of the prsent invention. In embodiments, the present invention relates to the provision of a pressure fixable encapsulated toner comprised of a core of a polymer binder obtained preferably by free radical polymerization, magnetic pigment, such as iron oxide or magnetite, encapsulated thereover with a shell obtained by interfacial polycondensation of amino acid with a polyisocyanate, and wherein the properties of the shell can be tailored to specific specifications by, for example, controlling the nature, amount and stoichiometry of shell precursors. The core polymer binder in embodiments can be obtained by free radical polymerization of vinyl monomers within the microcapsules after shell formation.

Preferably, the amino acids that are selected for forming the toner shells of the present invention are those which also contain an amide or a hydroxy functionality. Illustrative examples of amino acids include asparagine, dibromotyrosine, diiodotyrosine, glutamine, glycylalanine, glycylglysine, glycylleucine, hydroxyproline, serine, tyrosine and the like. Illustrative examples of polyisocyanates that can be utilized for reaction with the aforementioned acids are polyisocyanates selected, for example, from the group consisting of benzene diisocyanate, toluene diisocyanate, diphenylmethane diisocyanate, 1,6-hexamethylene diisocyanate, bis(4-isocyanatocyclohexyl)methane, MODUR CB-60 TM, MONDUR CB-75 TM, MONDUR MR TM, MONDUR MRS 10 TM, PAPI 27 TM, PAPI 135 TM, ISONATE 143L TM, ISONATE 181 TM, ISONATE 125M TM, ISONATE 191 TM, ISONATE 240 TM, Uniroyal Chemical's polyether VIBRATHANES B-604 TM, B-614 TM, B-635 TM, B-843 TM, Mobay Chemical Corporation's polyether isocyanate prepolymers E-21 or E-21A, XP-743, XP-744, and the like. Generally, 0.1 to about 2 molar equivalent excess of amino acid relative to polyisocyanates can be employed for the shell formation, and the shell generally comprises from about 1 to 20 weight percent of the final toner composition. The shell can be of an effective thickness of, for example, less than about 5 microns, and more specifically, less than about 1 micron as determined by transmission electron microscopic analysis of thin sections of embedded toner particles. During the aforementioned shell forming interfacial polycondensation, the temperature can be maintained at from about 15° C. to about 55° C., and preferably from about 20° C. to about 35° C. Also, the reaction time is generally from about 5 minutes to about 5 hours, and preferably from about 20 minutes to about 90 minutes.

Examples of amino acids include those represented by the formula

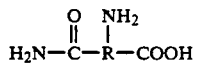

where R represents a trivalent aliphatic or trivalent aromatic group. Examples of aliphatic groups include those containing from 1 to about 25, carbon atoms while examples of aromatic groups include those containing from 6 to about 24 carbon atoms. Polyisocyanates that may be selected for the shell forming reaction to enable shell formation by interfacial polymerization are illustrated in U.S. Pat. No. 4,612,272, and U.K. Patents 2,107,670 and 2,135,469, the disclosures of which are totally incorporated herein by reference. Interfacial process selected for the shell formation of the toners of the present invention are as illustrated, for example, in U.S. Pat. Nos. 4,000,087 and 4,307,169, the disclosures of which are totally incorporated herein by reference.

Illustrative examples of core monomers, which are polymerized after microcapsule shell formation, and are present in an effective amount of from, for example, about 15 to about 90 weight percent, and preferably from about 20 to about 50 weight percent, include acrylates, methacrylates, olefins including styrene and its derivatives, and the like. Specific examples of core monomers include methyl acrylate, methyl methacrylate, ethyl acrylate, ethyl methacrylate, propyl acrylate, propyl methacrylate, butyl acrylate, butyl methacrylate, pentyl acrylate, pentyl methacrylate, hexyl acrylate, hexyl methacrylate, heptyl acrylate, heptyl methacrylate, octyl acrylate, octyl methacrylate, cyclohexyl acrylate, cyclohexyl methacrylate, lauryl acrylate, lauryl methacrylate, stearyl acrylate, stearyl methacrylate, benzyl acrylate, benzyl methacrylate, ethoxypropyl acrylate, ethoxypropyl methacrylate, methylbutyl acrylate, methylbutyl methacrylate, ethylhexyl acrylate, ethylhexyl methacrylate, methoxybutyl acrylate, methoxybutyl methacrylate, cyanobutyl acrylate, cyanobutyl methacrylate, tolyl acrylate, tolyl methacrylate, styrene, substituted styrenes, other substantially equivalent addition monomers, and other known addition monomers, reference for example U.S. Pat. No. 4,298,672, the disclosure of which is totally incorporated herein by reference, and mixtures thereof.

Various known pigments that can be selected include carbon black, like REGAL330®, magnetites, such as Mobay magnetites MO8029 TM, MO8060 TM; Columbian MAPICO BLACKS® and surface treated magnetites; Pfizer magnetites CB4799 TM, CB5300 TM, CB5600 TM, MCX636 TM; Bayer magnetites Bayferrox 8600 TM, 8610 TM; Northern Pigments magnetites, NP-604 TM, NP-608 TM; Magnox magnetites TMB-100 TM or TMB-104 TM; and other similar black pigments, including mixtures of these pigments with other colored pigments illustrated herein. Specific colored pigments that can be selected include HELIOGEN BLUE L6900 TM, D6840 TM, D7080 TM, D7020 TM, PYLAM OIL BLUE TM and PYLAM OIL YELLOW TM, PIGMENT BLUE 1 TM available from Paul Uhlich & Company, Inc., PIGMENT VIOLET 1 TM, PIGMENT RED 48 TM, LEMON CHROME YELLOW DCC 1026 TM, E.D. TOLUIDINE RED TM and BON RED C TM available from Dominion Color Corporation, Ltd., Toronto, Ontario, NOVAPERM YELLOW FGL TM, HOSTAPERM PINK E TM available from Hoechst, CINQUASIA MAGENTA TM available from E.I. DuPont de Nemours & Company, and the like. Primary colored pigments, that is known cyan, magenta, or yellow pigments, can also be selected for the toner compositions of the present invention. The aforementioned pigments can be incorporated into the microencapsulated toner compositions of the present invention in various effective amounts. In embodiments, the pigment is present in the toner composition in an amount of from about 2 percent by weight to about 65 percent by weight calculated on the weight of the dry toner.

Surface additives that can be selected to, for example, improve the surface characteristics of the toners in embodiments of the present invention include, for example, metal salts, metal salts of fatty acids, colloidal silicas, mixtures thereof and the like, which additives are usually present in an amount of from about 0.1 to about 5 weight percent, reference U.S. Pat. Nos. 3,590,000; 3,720,617; 3,655,374 and 3,983,045, the disclosures of which are totally incorporated herein by reference. Preferred surface additives include zinc stearate and AEROSIL R972®.

The aforementioned toner compositions of the present invention can be prepared by a number of different processes as indicated herein including chemical microencapsulation which involves a shell forming interfacial polycondensation and a core polymer binder forming free radical polymerization. The process is comprised, for example, of first thoroughly mixing or blending a mixture of core monomer or monomers, a free radical initiator, a colorant or mixture of colorants including magnetites, and a polyisocyanate or polyisocyanates; dispersing the aforementioned well blended mixture by high shear blending into stabilized microdroplets of specific droplet size and size distribution in an aqueous medium containing a suitable stabilizer or emulsifying agents, and wherein the volume average microdroplet diameter can be desirably adjusted to be from about 5 microns to about 30 microns with the volume average droplet size dispersity being less than 1.4 as inferred from the Coulter Counter measurements of the microcapsule particles after encapsulation; subsequently subjecting the aforementioned dispersion to the shell forming interfacial polycondensation by adding an amino acid, preferably glutamine; and thereafter initiating the core polymer binder forming free radical polymerization within the newly formed microcapsules with heat. The shell forming interfacial polycondensation is generally executed at ambient temperature, but elevated temperatures may also be employed depending on the nature and functionality of the shell components used. For the core polymer binder forming free radical polymerization, it is generally accomplished at temperatures of from ambient temperature to about 100° C., and preferably from ambient temperature to about 85° C.

Illustrative examples of free radical initiators that can be selected include azo compounds such as 2-2'-azodimethylvaleronitrile, 2-2'-azoisobutyronitrile, azobiscyclohexanenitrile, 2-methylbutyronitrile, or mixtures thereof, and other similar known compounds with the quantity of initiators being, for example, from about 0.5 percent to about 10 percent by weight of that of core monomers. Stabilizers selected include water soluble polymeric surfactants such as poly(vinyl alcohols), partially hydrolyzed poly(vinyl alcohols), hydroxypropyl cellulose, and methyl cellulose with a stabilizer to water ratio of from about 0.05 to about 0.75 for example.

The encapsulated toner compositions of the present invention are mechanically stable and possess excellent shelf life stability in many embodiments thereof. For example, they do not suffer from premature rupture, and are nonblocking and nonagglomerating. The shell materials of the present invention are highly polar in nature, and display an excellent capability in containing the core component, particularly the core polymer binder and dye molecules. In addition, the toner compositions of the present invention enable the achievement of a relatively high initial fix of, for example, 50 percent, thereby permitting the toner compositions to be utilized in duplex xerographic printing and imaging systems without undue complications such as image offset or image smear. Furthermore, the toner compositions of the present invention also offer in some embodiments a very high final image fix of over 90 percent, thereby ensuring excellent image permanence characteristics for high quality printing. Moreover, the toner compositions of the present invention in embodiments are essentially free of agglomeration in that the toners display consistently acceptable powder flow characteristics, and their particle diameters, 10 to about 25 microns, do not increase over a long period of time.

Also, the toner compositions can be rendered conductive with, for example, a volume resistivity value of from about $10^3$ ohm-cm to about $10^8$ ohm-cm by adding to the toner surface thereof components such as carbon blacks, graphite, and conductive organometallic compounds. The aforementioned conductive toner compositions of the present invention are particularly useful for the inductive development of electrostatic images. More specifically, in accordance with the present invention, there is provided a method for developing electrostatic images which comprises forming latent electrostatic images on a hard dielectric surface of an image cylinder by depositing ions from a corona source; developing the images with the single component magnetic toner composition illustrated herein; followed by simultaneously transferring and fixing by pressure onto paper with a toner transfer efficiency greater than 95 percent, and in many instances over 99 percent. The transfix pressure utilized for image fixing is generally between less than 1,000 psi to about 4,000 psi, but preferably the transfix pressure is set at 2,000 psi to eliminate or alleviate paper calendering and high image gloss problems. Examples of pressure fixing processes and systems that can be selected include those commercially available from Delphax, Inc., Hitachi Corporation, and Cybernet, Inc..

The present invention is also directed to methods for the development of images by, for example, forming by ion deposition on an electroreceptor, such as a polymer impregnated anodized aluminum oxide, a latent image, developing this image with the pressure fixable encapsulated toner compositions of the present invention, and subsequently simultaneously transferring and fixing the image to a suitable substrate such as paper.

For two component developers, carrier particles including steel ferrites, copper zinc ferrites, and the like, with or without coatings, can be admixed with the encapsulated toners of the present invention, reference for example the carriers illustrated in U.S. Pat. Nos. 4,937,166; 4,935,326; 4,560,635; 4,298,672; 3,839,029; 3,847,604; 3,849,182; 3,914,181; 3,929,657 and 4,042,518, the disclosures of which are totally incorporated herein by reference.

In embodiments, the polymeric shell represents from about 1 percent to about 30 percent by weight of toner, the core binder represents from about 20 percent to about 95 percent by weight of toner, and the color pigment including magnetite, dye or mixtures thereof represents from about 2 percent to about 60 percent by weight of toner.

The following Examples are being submitted to further define various species of the present invention. These Examples are intended to be illustrative only and are not intended to limit the scope of the present invention.

EXAMPLE I

A 20.1 micron (volume average diameter) pressure fixable encapsulated toner with a core comprised of poly(lauryl methacrylate) and magnetite, and a microcapsule shell derived from glutamine and ISONATE 143L TM was prepared as follows:

A mixture of lauryl methacrylate (134.8 grams), 2,2'-azo-bis-(2,4-dimethyl-valeronitrile) (2.62 grams), 2,2'-azobis-(isobutyronitrile) (2.62 grams), and ISONATE 143L TM (47.0 grams) was homogenized in a 2 liter Nalgene container with an IKA polytron at 4,000 RPM for 30 seconds. To this mixture were then added Northern Pigments' magnetite NP-608 TM (280.0 grams) and dichloromethane (20 milliliters), and the corresponding slurry was homogenized at 8,000 RPM for four minutes. To the resulting mixture was added 1 liter, 0.12 percent (by weight), of aqueous poly(vinyl alcohol) (88 percent hydrolyzed; MW 96,000) solution, and thereafter, the mixture was homogenized again at 9,000 RPM for 2 minutes. The resulting dispersion was transferred to a 2 liter reaction kettle immersed in an oil bath, and equipped with a mechanical stirrer. To the kettle was then added a solution of the glutamine (26.5 grams) in 80 milliliters of water, and the resulting mixture was allowed to react for 1 hour. Thereafter, the kettle was heated to 90° C. over a period of 1.5 hours, and retained at this temperature for another 6.0 hours before cooling down to room temperature, about 25° C. The resulting encapsulated particles of the reaction mixture were allowed to settle to the bottom of the kettle by gravity, and the supernatant was carefully decanted. The residue was then transferred to a 4 liter beaker, and diluted with water to a volume of about four liters with constant stirring. The encapsulated toner particles were then allowed to settle to the bottom of the beaker, and the aqueous supernatant was again carefully decanted. Washing was repeated in this manner for several times until the washing was clear. The washed encapsulated particles were transferred to a 2 liter beaker and diluted with water to a total volume of 1.8 liters. A suspension of AQUADAG GRAPHITE E TM (19.9 grams, from Acheson Colloids) in water (100 milliliters) was then added, and the mixture was spray dried in a Yamato Spray Dryer at an air inlet temperature of 160° C., and an air outlet temperature of 80° C. The air flow was maintained at 0.75 $m^3$/minute, while the atomizing air pressure was set at 1.0 kilogram/$cm^2$. The collected dry encapsulated particles (315.0 grams) were screened through a 63 micron sieve; the particle's volume average particle diameter, as measured on a 256 channel Coulter Counter, was 20.1 microns with a volume average particle size dispersity of 1.30.

Two hundred and forty (240.0) grams of the above encapsulated particles were dry blended using a Greey blender, first with 0.75 gram of carbon black (BLACK PEARLS 2,000 TM) for 2 minutes at 3,500 RPM, and then with 3.75 grams of zinc stearate for an additional 10 minutes at 3,000 RPM to provide a final encapsulated toner product with a volume resistivity of $6.3\times10^4$ ohm-cm.

The pressure fixing ionographic printer selected for the testing of the toner compositions was the Delphax S-6000 TM printer. The developed images were transfixed at a pressure of 2,000 psi. Print quality was evaluated from a checkerboard print pattern. The image optical density was measured using a standardized integrating densitometer. Image fix was measured by the standardized tape pull method wherein a tape was pressed with a uniform reproducible standard pressure such as hand pressure against the developed image and then removed. The image fix level is expressed as a percentage of the retained image optical density after the tape test relative to the original image optical density. Image ghosting was evaluated qualitatively for over 2,000 prints. Toner shell integrity was judged qualitatively by observing any crushed or agglomerated toner on the hopper screen through which toner was fed to the machine magnetic roller. If crushed toner was found to adhere to and clog some of the screen openings after 2,000 copies, it was judged to have a premature toner rupture problem.

For the encapsulated toner as obtained in this Example, the initial and final fix levels were, respectively, 55 percent and 94 percent. No image ghosting and toner agglomeration were observed for 2,000 prints.

EXAMPLE II

A 19.6 micron pressure fixable encapsulated toner with a core comprised of poly(lauryl methacrylate) and a magnetite, and a microcapsule shell derived from glutamine and ISONATE 143L TM was prepared in accordance with the process of Example I except that no surface additives were applied to the toner. The toner has a volume average particle size dispersity of 1.28, and a volume resistivity of $2.4\times10^4$ ohm-cm. The toner was tested according to the procedure of Example I and substantially similar results were obtained.

EXAMPLE III

A 15.8 micron encapsulated toner with a core comprised of poly(lauryl methacrylate) and a magnetite, and a microcapsule shell derived from glutamine and ISONATE 143L TM was prepared in accordance with the procedure of Example I except that 0.20 percent of aqueous poly(vinyl alcohol) solution and 53 grams of glutamine were utilized instead of, respectively, 0.12 percent of aqueous poly(vinyl alcohol) solution and 26.5 grams of glutamine. A total of 296.0 grams of dry encapsulated particles was collected. The particles' volume average particle diameter was measured to be 15.8 microns and its volume average particle size dispersity was 1.24.

Two Hundred and twenty-five (225.0) grams of the above encapsulated particles were dry blended using a Greey blender, first with 0.75 gram of carbon black (BLACK PEARLS 2000 TM) for 2 minutes with the blending impeller operating at 3,500 RPM, and then with 3.6 grams of zinc stearate for another 8 minutes at an impeller speed of 3,000 RPM to provide a final toner product with a volume resistivity of $4.3\times10^5$ ohm-cm. This toner provided initial and final fix levels of, respectively, 55 percent and 93 percent without image ghosting for 2,000 prints when tested in accordance with the procedure of Example I.

EXAMPLE IV

A 15.7 micron encapsulated toner with a core comprised of poly(isodecyl acrylate) and a magnetite, and a microcapsule shell derived from glutamine and ISONATE 143L TM was prepared in accordance with the procedure of Example I except that isodecyl acrylate (133.8 grams) was substituted for lauryl methacrylate and 3.12 grams of 2,2'-azobis-(2,4-dimethyl-valeronitrile) and 2,2'-azobis-(isobutyronitrile) were used. Also, 0.20 percent, instead of 0.12 percent, of aqueous poly(vinyl alcohol) solution was utilized. A total of 305.0 grams of dry encapsulated particles were obtained with the particle's volume average diameter being 15.7 microns, and its volume average particle size dispersity being 1.26. The particles were dry blended in accordance with the procedure of Example I providing a volume resistivity of $1.0\times10^5$ ohm-cm. The toner displayed initial and final fix levels of 54 percent and 95 percent, respectively, when tested in accordance with the procedure of Example I. No image ghosting or toner agglomeration were observed in the print testing.

EXAMPLE V

A 16.7 micron encapsulated toner with a core comprised of poly(lauryl methacrylate) and a magnetite, and a microcapsule shell derived from asparagine and ISONATE 143L TM was prepared in accordance with the procedure of Example I with the exception that 26.0 grams of asparagine was utilized in place of glutamine. Also 0.20 percent (by weight) of a poly(vinyl)alcohol was substituted for 0.12 percent. A total of 310.0 grams of dry encapsulated particles were obtained with the particle's volume average particle diameter being 16.7 microns and its volume average particle size dispersity being 1.25. The encapsulated particles were dry blended in accordance with the procedure of Example I providing a final toner product with a volume resistivity of $7.7\times10^4$ ohm-cm, and when this toner was tested in accordance with the procedure of Example I, substantially similar results were obtained.

EXAMPLE VI

A 15.5 micron encapsulated toner with a core comprised of poly(lauryl methacrylate) and a magnetite, and a microcapsule shell derived from tyrosine and ISONATE 143L TM was prepared in accordance with the procedure of Example V with the exception that 35.0 grams of dl-tyrosine was utilized in place of asparagine. A total of 303.0 grams of dry encapsulated particles were obtained with the particle's volume average particle diameter being 15.5 microns and its volume average particle size dispersity being 1.25. The encapsulated particles were dry blended in accordance with the procedure of Example I providing a final toner product with a volume resistivity of $6.9\times10^4$ ohm-cm, and when this toner was tested in accordance with the procedure of Example I, substantially similar results were obtained.

Other modifications of the present invention may occur to those skilled in the art subsequent to a review of the present application, and these modifications, including equivalents thereof, are intended to be included within the scope of the present invention.

What is claimed is:

1. An encapsulated toner composition consisting essentially of a core consisting essentially of a polymer binder and pigment encapsulated in a shell consisting essentially of the polycondensation product of a polyisocyanate and an amino acid with an amide functionality and wherein the amino acid selected is represented by the formula:

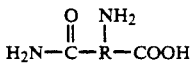

where R represents a trivalent aliphatic or trivalent aromatic group.

2. A toner in accordance with claim 1 wherein the shell is formed by interfacial polymerization.

3. A toner in accordance with claim 1 wherein the polyisocyanate is selected from the group consisting of benzene diisocyanate, toluene diisocyanate, diphenylmethane diisocyanate, 1,6-hexamethylene diisocyanate, and bis(4-isocyanatocyclohexyl)methane.

4. A toner in accordance with claim 1 wherein the polyisocyanate is toluene diisocyanate or diphenylmethane diisocyanate.

5. A toner in accordance with claim 1 wherein the core polymer binder is an acrylate polymer, a methacrylate polymer, or a styrene polymer.

6. A toner in accordance with claim 1 wherein the core polymer binder is derived from polymerization of vinyl monomers selected from the group consisting of methyl acrylate, methyl methacrylate, ethyl acrylate, ethyl methacrylate, propyl acrylate, propyl methacrylate, butyl acrylate, butyl methacrylate, pentyl acrylate, pentyl methacrylate, hexyl acrylate, hexyl methacrylate, heptyl acrylate, heptyl methacrylate, octyl acrylate, octyl methacrylate, cyclohexyl acrylate, cyclohexyl methacrylate, lauryl acrylate, lauryl methacrylate, stearyl acrylate, stearyl methacrylate, benzyl acrylate, benzyl methacrylate, ethoxypropyl acrylate, ethoxypropyl methacrylate, methylbutyl acrylate, methylbutyl methacrylate, ethylhexyl acrylate, ethylhexyl methacrylate, methoxybutyl acrylate, methoxybutyl methacrylate, cyanobutyl acrylate, cyanobutyl methacrylate, tolyl acrylate, tolyl methacrylate, styrene, and substituted styrenes.

7. A toner in accordance with claim 1 wherein said aliphatic group contains 1 to about 12 carbon atoms, and said aromatic group contains from 6 to about 24 carbon atoms.

8. A toner in accordance with claim 1 wherein the pigment is carbon black, magnetite, or mixtures thereof.

9. A toner in accordance with claim 1 wherein the pigment is cyan, yellow, magenta, red, green, blue, brown, or mixtures thereof.

10. A toner in accordance with claim 1 wherein said shell represents from about 1 percent to about 30 percent by weight of toner, the core polymeric binder represents from about 20 percent to about 95 percent by weight of toner, and said pigment including magnetite, dye or mixtures thereof represents from about 2 percent to about 60 percent by weight of toner.

* * * * *